United States Patent [19]

Fleckenstein et al.

[11] 4,003,710

[45] Jan. 18, 1977

[54] CHEMICAL FEEDER FOR WATER SOFTENERS

[75] Inventors: Andrew Joseph Fleckenstein, Brookfield; Herman C. Mitchell, Wauwatosa, both of Wis.; Donald G. Fettes, Regina, Canada

[73] Assignee: L. W. Fleckenstein, Inc., Butler, Wis.

[22] Filed: Jan. 17, 1975

[21] Appl. No.: 541,936

[30] Foreign Application Priority Data

Feb. 1, 1974 Canada ..... 191,533

[52] U.S. Cl. ..... 23/267 R; 23/272.8; 210/257 M; 210/205; 137/268; 222/386.5

[51] Int. Cl.[2] ..... B01F 1/00

[58] Field of Search ..... 23/267, 272.7, 272.8, 23/267 R, 267 E, 267 F, 272.8 F; 137/268; 222/386.5; 210/198, 205, 257 M

[56] References Cited

UNITED STATES PATENTS

| | | | |
|---|---|---|---|
| 601,877 | 4/1898 | Lochmann | 222/386.5 |
| 1,372,190 | 3/1921 | Randall | 23/272.8 F |
| 1,923,266 | 8/1933 | Houpert | 23/272.7 |
| 2,573,299 | 10/1951 | Bast | 23/272.8 |
| 2,703,176 | 3/1955 | Shuldener | 23/272.7 |
| 2,984,250 | 5/1961 | Foster | 23/272.8 |
| 3,052,525 | 9/1962 | Vogelmann | 23/272.8 |
| 3,056,419 | 10/1962 | Westman | 23/272.7 |
| 3,084,712 | 4/1963 | Brown | 23/272.7 |
| 3,096,000 | 7/1963 | Staley | 222/386.5 |
| 3,165,114 | 1/1965 | Garrett | 23/272.8 |
| 3,166,096 | 1/1965 | Lang | 23/272.8 |
| 3,190,726 | 6/1965 | Rudelick | 23/272 AH |
| 3,195,558 | 7/1965 | Klueber | 23/272.7 |
| 3,493,496 | 2/1970 | Bray | 210/257 M |
| 3,836,335 | 9/1974 | Eppes | 222/386.5 |
| 3,862,708 | 1/1975 | Waxlax | 222/386.5 |

FOREIGN PATENTS OR APPLICATIONS

| | | | |
|---|---|---|---|
| 76,231 | 1947 | Czechoslovakia | 23/272.8 |
| 1,375,881 | 9/1963 | France | 23/272.8 |
| 1,596,676 | 6/1970 | France | 23/272.7 |

*Primary Examiner*—Stephen J. Emery
*Attorney, Agent, or Firm*—McWilliams & Mann

[57] ABSTRACT

A self-contained unit for regenerating chemicals used with water softeners and the like. The unit is quickly attachable to and detachable from a water treatment system.

3 Claims, 5 Drawing Figures

Fig. 2.
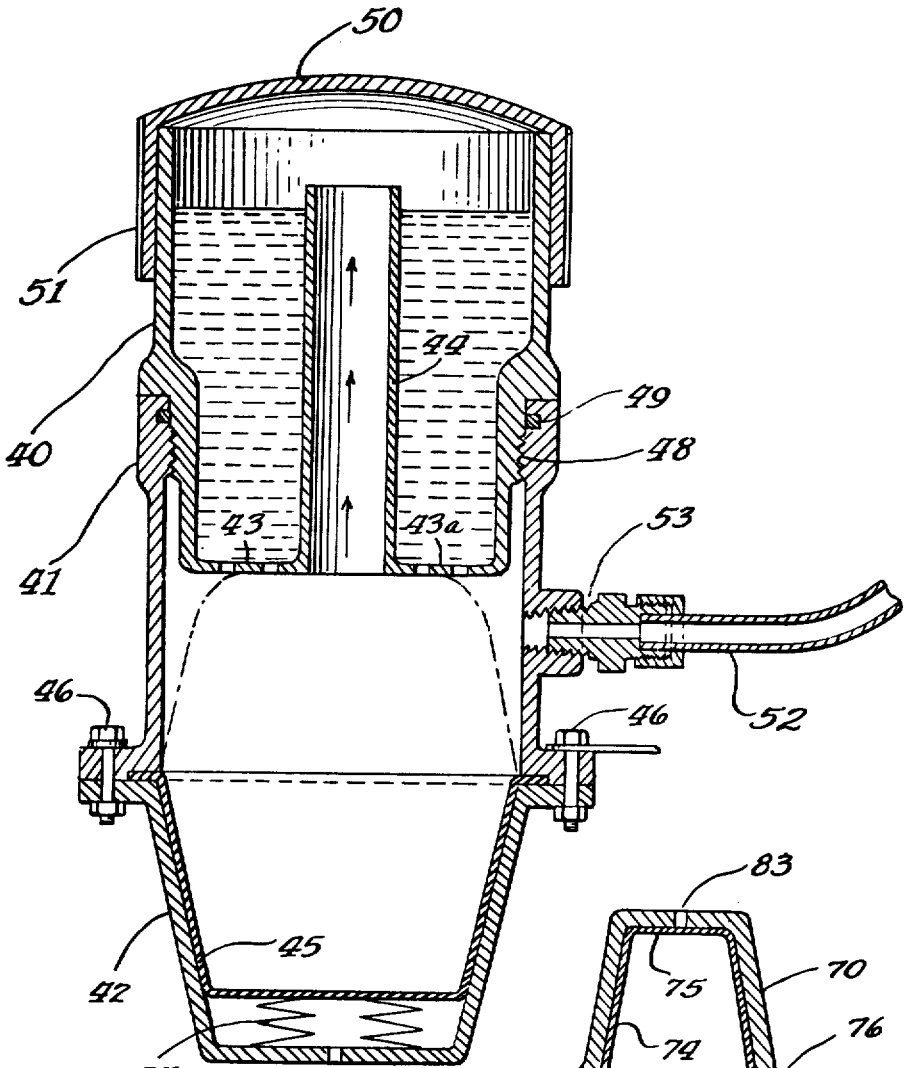
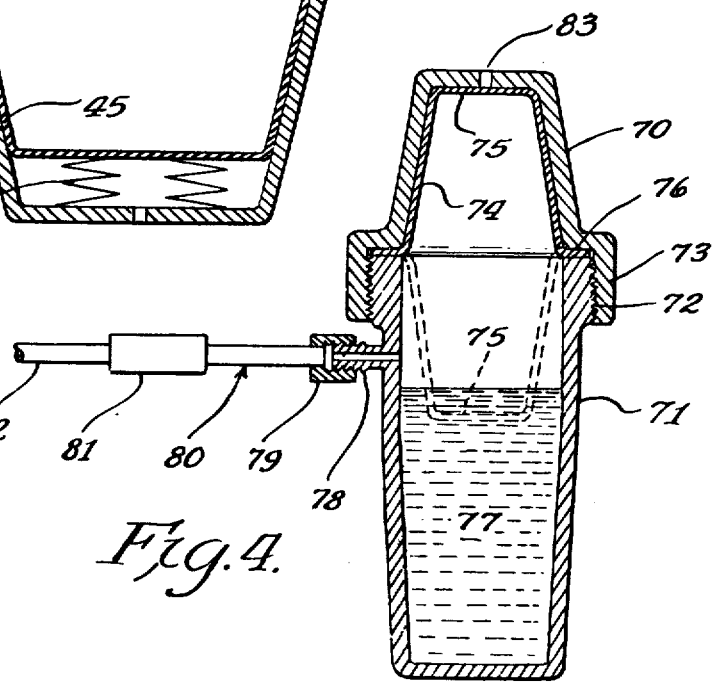
Fig. 4.

105
104
103
107
102
90
95
100
97
94
98
99
100A
101
96
91
93
91
92
106

CHEMICAL FEEDER FOR WATER SOFTENERS

The present invention is directed to improvements in water treatment systems of the type utilizing chemicals for regeneration purposes, as in ion exchange apparatus, or as in filters which precipitate undesired elements or compounds from the water, or as in feeding ion exchange resin cleaners.

In apparatus of this type it is generally customary to use a valve controlled suction line which is connected to a regenerating chemical tank for withdrawing chemical solution and using it for purposes of regenerating a material. In the past, these chemical tanks have been exposed to the atmosphere. Some regenerating chemicals, as, for example, potassium permanganate which is used to regenerate green sand in iron filter systems, are hard to handle and are dangerous from the standpoint of human exposure. In systems of this general type it is necessary to replace a regenerating chemical from time to time and, in the case of dangerous chemicals, handling of the chemical when replacing the same requires special precautions.

With the foregoing in mind, the major purposes of the present invention are to provide new and improved facilities for handling regenerative chemicals and which in essence provide a closed and readily replaceable container for the chemical while at the same time enabling convenient use and replacement of the chemical, and while minimizing exposure of the chemical to persons handling the same or in the vicinity of the same.

Another important purpose of the invention is to positively provide an exacting amount of chemical each time it delivers chemical. This is important so that excessive chemical is avoided and thus it can be properly rinsed from the filter or ion exchange system. Thus, no chemical contamination remains in the water supply after a regeneration. Also, exact chemical delivery means chemical savings, and efficient regeneration.

These and other purposes will appear from time to time in the course of the ensuing specification and claims when taken with the accompanying drawings, in which:

FIG. 2 is a diagrammatic sectional view of another embodiment of the invention;

FIG. 4 is a diagrammatic view, in section, of another embodiment of the invention.

Like elements are designated by like characters throughout the specification and drawings.

Figure 1:
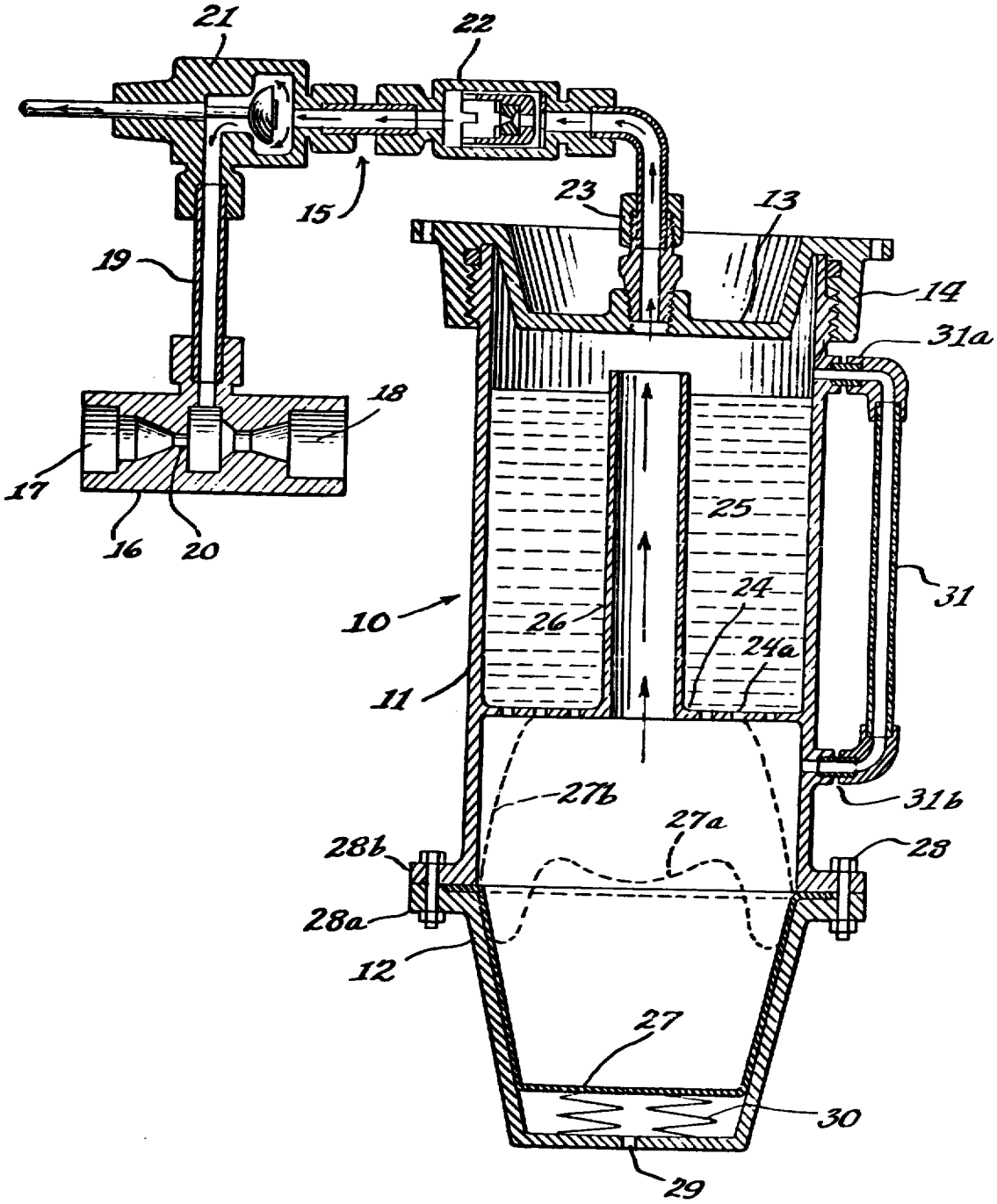
FIG. 1 is a diagrammatic view partly in section of a regenerative chemical system embodying the principles of the present invention.

With specific reference now to the drawings, and in the first instance to FIG. 1, the numeral 10 generally designates a container for holding a regenerative chemical and a solution of the chemical in water. Container 10 is defined by a first cylindrical section 11, a bottom closure section or cap 12 and a removable upper closure section 13.

The upper closure section 13 may be defined by a transverse plate having a depending screw-threaded flange 14 in threaded engagement with threads on the upper end of section 11.

A suction and makeup water conduit is generally designated at 15. The conduit may typically consist of a venturi fitting 16 having a water inlet passage 17 and outlet passage 18. A pipe 19 is coupled to venturi passage section 20 so that as water passes from the inlet 17 to the outlet 18 it creates a suction to withdraw solution through the pipe 19. The overall conduit system may also include shut-off valve fitting 21, a flow control 22 between a spring biased valve 21 and a fitting 23 which is coupled to the closure 13 to afford communications with the container 11.

Shut-off valve 21 may open and close under control of a timing motor system as is known to the art. It is spring biased to the closed position. In systems of this type, makeup water may be supplied to the container 10 by means of subjecting both inlet 17 and outlet 18 to the same water pressure when valve 21 is open.

The tank section 11 includes a transverse partition wall 24 which serves as a support for a body of chemical 25 positioned above the wall. The partition wall 24 also serves to divide the container into a chemical space and a chemical solution space which is represented by the volume beneath wall 24.

An upstanding pipe 26 is fixed to the wall and extends upwardly to a point short of the closure 13. Pipe 26 provides for communication of water and chemical solution to and from the space beneath wall 24. For example, makeup water may be added through the conduit assembly 15 for filling the container. In use, water is added so that the container is full, whereupon the chemical goes into solution in the water. The solution may pass through pipe 26. Apertures **24*a* may be provided in the transverse wall, although the apertures 24*a*** are not necessarily required for proper dissolving of the chemical.

A diaphragm 27 extends across the lower interior portion of the container and is clamped in position by bolts 28 which are used to clamp mating flanges **28*a* and 28*b* of the bottom cap 12 and section 11 together. The flexible diaphragm 27 may be formed so that it occupies the full line position illustrated in FIG. 1 when the container is substantially full of liquid and pressurized. As chemical solution is withdrawn from the container, the diaphragm 27 may flex upwardly in consonance with solution displaced from the container so as to maintain the suction condition in the conduit assembly. Upward flexed positions of diaphragm 27 are illustrated at 27*a* and 27*b***.

Bottom cap 12 includes a vent 29 so as to allow air to enter the space beneath diaphragm 27 as the diaphragm flexes upwardly with withdrawal of solution from the container. A spring 30 may be positioned between the diaphragm 27 and the opposed wall of the bottom cap 12 to assist the upward flexing of the diaphragm. This spring may also compensate for variations in volume that may occur as the chemical goes into solution or because of temperature changes. Flexing may also be assisted by entrapped air in the bottom chamber and in this case hole 29 would be plugged.

The section 11 of the container may include a glass sight tube 31 to indicate the level of solution within the container.

Sight tube 31 may be fixed to the section 11 through removable couplings **31*a* and 31*b* to enable simple attachment of the sight tube 31 to the section 11** and detachment therefrom.

In the embodiment of FIG. 1, the container is closed during use, thus minimizing exposure of the chemical solution. When the chemical solution needs replacement, cap 13 may be unscrewed from section 11, whereupon intermediate section 11 may be replenished with chemicals. Such replacement chemical may be in the form of an easily handled cylindrical cake which fits the container. As an alternative, intermediate section 11 may be disposed of and a new intermediate section with fresh chemical substituted in its place. For this purpose, a replacement and disposable section 11 may be sold out and stored for use with a closure cap corresponding to cap 13 except for the coupling 23.

FIG. 2 illustrates another embodiment of the invention. In FIG. 2, the container is defined by an upper tank section 40, an intermediate tank section 41, and a lower cap section 42. In FIG. 2, the upper section 40 serves as a chemical storage section. Section 40 includes a transverse wall 43 similar to wall 24 in FIG. 1 and may have apertures 43*a* therein. An upstanding pipe 44 is fixed to the transverse wall 43 and affords communication between the upper portion of the section and the space beneath the partition wall as does the pipe 26 in FIG. 1.

A diaphragm 45 is clamped between mating flanges of the lower section 42 and the intermediate section as by means of bolts 46 in a manner identical to the clamping of the diaphragm in FIG. 1. A spring 47, as in FIG. 1, extends between the diaphragm and the lower portion of cap 42 to assist the upward flexing of the diaphragm.

In the embodiment of FIG. 2, the chemical storage section 40 includes screw threads 48 on the lower portion thereof to enable coupling to mating interior threads of the interior wall of section 41. Gaskets or seals 49 are disposed between the lower wall of section 40 and the wall of intermediate section 41 to provide a fluid-tight assembly.

In the embodiment of FIG. 2, the upper section 40 includes a closure cap 50 which is fixed over the upper portion of section 40 in a fluid-tight relation. For this purpose, section 40 may be formed of a plastic material whereupon a depending circular flange 51 of the cap may be solvent-welded to the section 40 after the section is filled with chemical.

In FIG. 2 the chemical storage section 40 is entirely disposable. The overall arrangement provides an airtight container which prevents exposure of the chemical solution to the atmosphere. When chemical needs replacing, upper section 40 is unscrewed from section 41 and a new chemical storage section screwed in place.

To facilitate the use of the section 40 as a disposable and replaceable chemical section, the section may be sold and stored with a removable plate disposed across the bottom of the container to prevent loss of chemical or exposure of chemical during storage and handling, or the chemical may be in a molded cake form as described with respect to FIG. 1.

In FIG. 2, a conduit assembly (suction and makeup water) similar to the assembly described in FIG. 1 is diagrammatically indicated at 52. In this embodiment the conduit assembly is in communication with the volume within the container beneath transverse wall 43 as by means of a fitting 53.

In FIG. 2, makeup water is supplied to the container through the conduit assembly 52 to fill the container completely and eliminate voids therein in a manner similar to the embodiment in FIG. 1. When chemical solution is needed for regenerative purposes, suction in the conduit assembly 52 withdraws solution as in the embodiment of FIG. 1.

Figure 3:
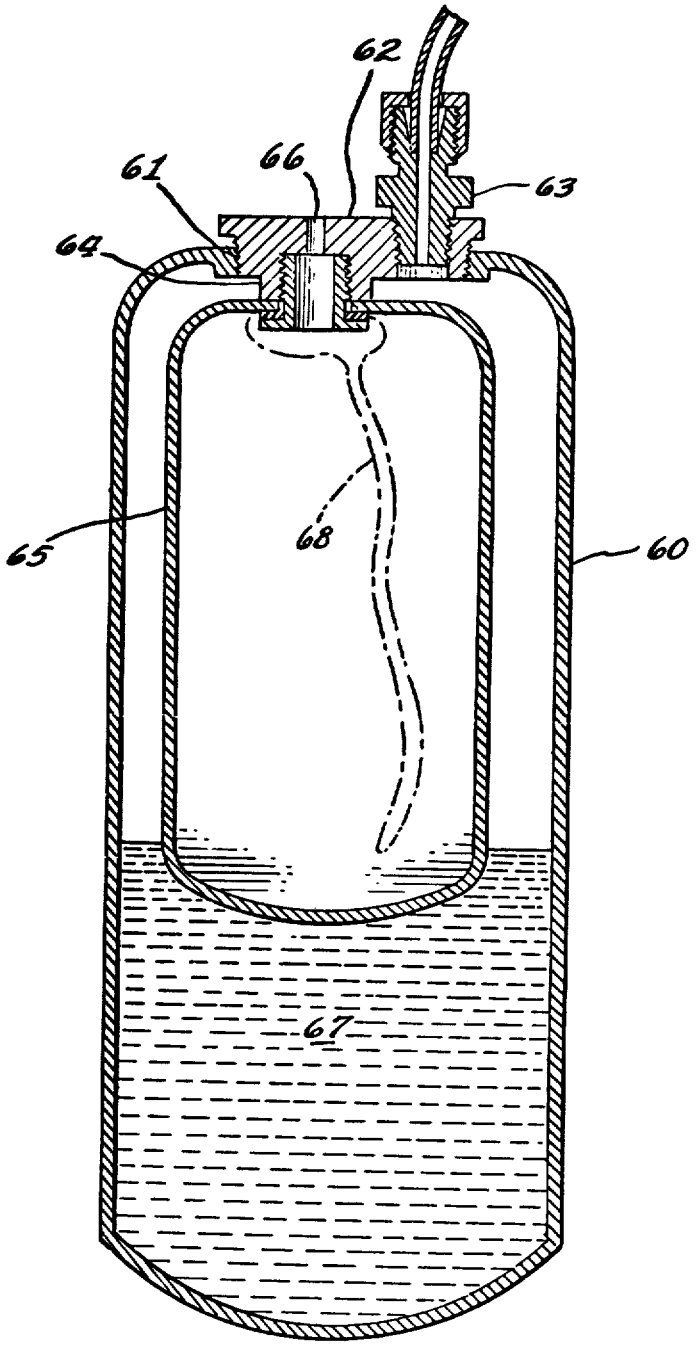
FIG. 3 is a diagrammatic view, in section, of still another embodiment of the invention.

FIG. 3 illustrates still another embodiment of the invention. In FIG. 3 a container body is designated at 60 and is in the form of an upright cylindrical tank having a screwthreaded opening 61 in the top portion thereof. A closure assembly 62 is threaded into this opening. Closure assembly 62 includes a fitting 63 for coupling to a makeup water and suction conduit assembly of the same type illustrated in FIG. 1.

In FIG. 3, the closure plate 63 includes a depending circular boss 64. A diaphragm in the form of a hollow cylindrical bladder 65 is clamped to this boss in a sealing relation. The interior of the bladder 65 is in communication with the atmosphere through a passage 66 formed through the boss and through the closure plate.

In FIG. 3, a receptacle 60 includes a body of chemical 67 disposed in the bottom portion thereof. Bladder 65 is collapsed (as indicated generally by the dotted line 68) when the receptacle is filled with water. The undeformed condition of the diaphragm is indicated in full lines in FIG. 3. As chemical solution is withdrawn, the displacement of solution from the receptacle allow the diaphragm to flex towards its undistorted condition to thereby compensate for displacement of solution from the receptacle by a corresponding volume increase in displacement of the diaphragm towards the undistorted condition thereof.

In FIG. 3, the container is closed to the atmosphere as in FIGS. 1 and 2, Chemical may be supplied in the receptacle, in which case a removable closure cap is fixed to the opening in the top of the receptacle. Such a closure can take the form in the closure illustrated at 62 except without the fitting 63, vent 66, and diaphragm. When such a receptacle is used, the closure plate is removed and the closure plate 62 with diaphragm and liquid fitting 63 is substituted in place thereof.

Some air may be trapped in the solution space of the containers after initial filling with water, but this will be withdrawn substantially with the suction action of the first regenerative cycle.

FIG. 4 illustrates a further modification of the invention. In FIG. 4 the container is defined by upper and lower sections 70 and 71, respectively. The upper and lower sections 70 and 71 are coupled together through use of exterior screw threads 72 on the upper end of the lower section and interior threads in a bell-like flange 73 at the lower side of the upper section. A flexible diaphragm 74 has an area greater than the cross-sectional area of the general cylindrical space within the sections and has the marginal portions 76 thereof clamped between the upper end surface of the lower section 71 and a shoulder 76 at the juncture of the flanged portion 73 with the remainder of the upper section. Diaphragm 74 is capable of flexure between the solid line upper position illustrated, and the dotted line lower position illustrated.

The lower section carries the regenerative chemical 77. Lower section 71 also is formed with a water inlet fitting 78 which is coupled to and sealed to a coupling 79 on a water line 80. Fitting 78 is preferably located at a level about the lowermost or evacuated position of the diaphragm to minimize the presence of air in the chemical filling position. The line 80 may include quick disconnect fitting 81 of a conventional type which will close of the supply passage 82 leading to the control valve assembly of the type illustrated in FIG. 1 when the coupling 81 is disconnected.

The upper section 70 preferably has a vent 83 to allow the free passage of air into and out of the upper section in the space of the upper section on the side of flexible diaphragm 75 opposite to the chemical and chemical solution side.

The system of FIG. 4 is designed to be manufactured, sold and used as a completely disposable unit. The upper and lower sections 70 and 71 may be defined by molded plastic material with the water inlet and solution fitting 78 molded integrally with the lower section. The unit may be assembled by the regenerative chemical supplier by filling the lower section 71 with chemical to an appropriate amount, after which time the diaphragm 75 and upper section 70 are assembled with the lower section as shown. The user may then connect such a container in position through use of coupling 79 and/or quick disconnect fitting 81. During use of the system, water is supplied to the container as in FIGS. 1–3 to provide a solution therein. Water may be supplied to a point where diaphragm 75 is flexed upwardly towards the full line position illustrated in FIG. 4. As solution is withdrawn, diaphragm 75 flexes downwardly with the withdrawal of solution until the solution is substantially exhausted, whereupon diaphragm 75 occupies the lower or dotted line position as illustrated in FIG. 4. When the system needs replacement of chemical, the entire container is simply disconnected from the line and disposed of, whereupon a new container is fitted in place.

Since the unit is self-contained and sealed from the exterior except through the water and solution flow passage, human exposure to the unit is held to a minimum both during use and during replacement.

Figure 5:
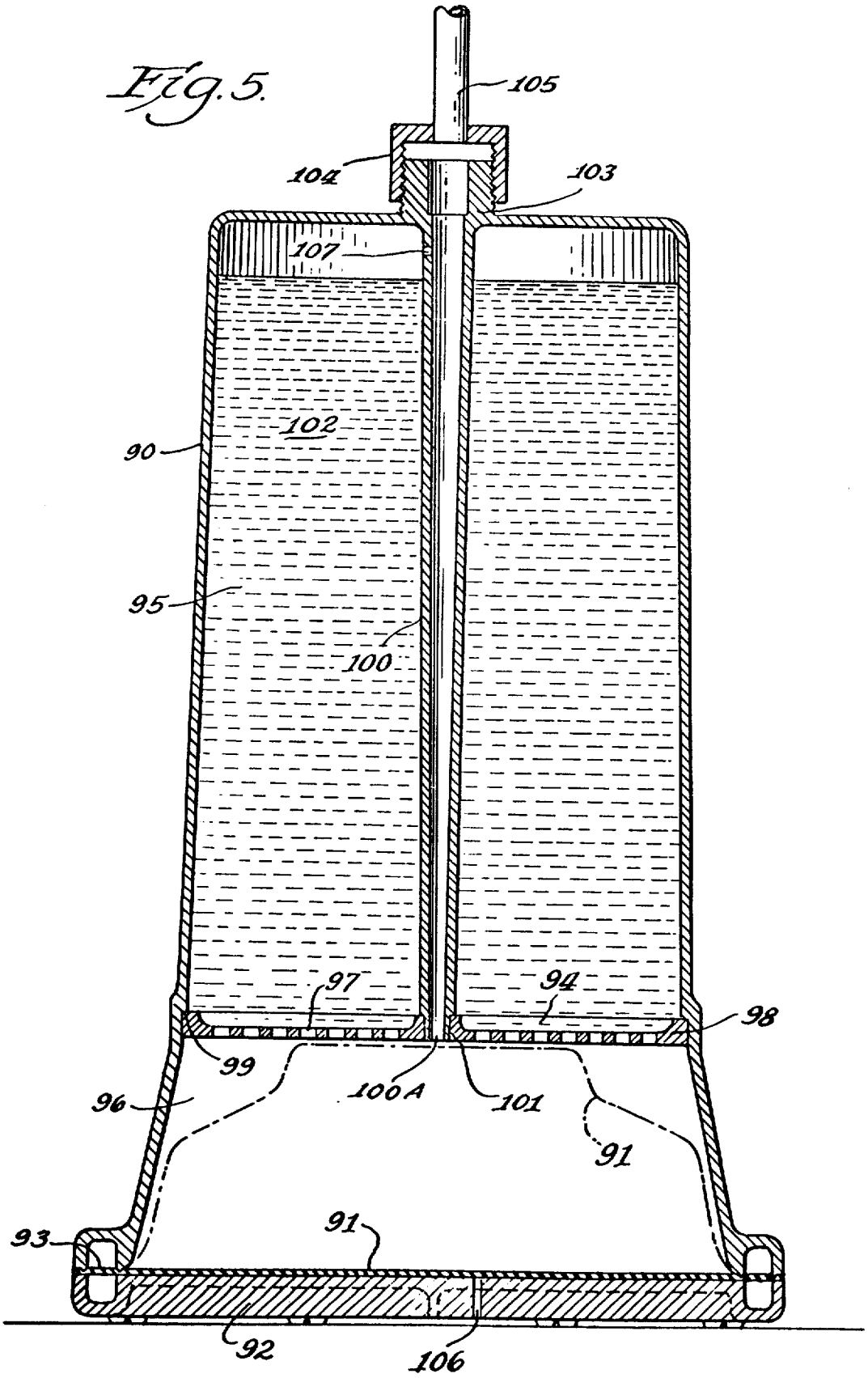
FIG. 5 is a diagrammatic view, in section, of another embodiment of the invention.

FIG. 5 illustrates an additional modification of the invention. In FIG. 5 the container is defined by a single housing section 90. A flexible diaphragm 91 is provided and has an area greater than the cross-sectional area of the general cylindrical space within the housing section. A lower base section 92 is illustrated as attached to the housing section 90. The diaphragm 91 has marginal portions 93 clamped between the housing section 90 and the base section 92. Diaphragm 91 is capable of flexure between the solid line lower position illustrated and the dotted line upper position illustrated.

A grid 94 separates the housing section 90 into an upper chamber 95 and a lower chamber 96. The grid includes a plurality of apertures 97 allowing fluid communication between upper and lower chambers. The grid also includes an outer peripheral flange 98 which engages a recess 99 formed in the housing section 90. The grid 94 is held in place by a central fluid conduit 100 which is received with an opening 101 in the grid 94 and is suitably fastened thereto as by means of solvent welding. The conduit 100 at its lower end includes an outlet port 100A.

The upper section 95 carries the regenerative chemical 102. The housing section 90 is formed with a water inlet fitting 103 which is coupled to and sealed to a coupling 104 on a water line 105. The line 105 is adapted to be connected to a control valve assembly of the type illustrated in FIG. 1 preferably through a quick disconnect coupling as previously discussed.

The lower base section 92 includes a vent 106 to allow the free passage of air into and out of the space below the diaphragm 91 opposite to the chemical and chemical solution side. The central fluid conduit 100 includes a vent 107 which enables evacuation of the upper chamber 95 prior to initial filling.

The system of FIG. 5 is designed to be manufactured, sold and used as a completely disposable unit. The unit may be assembled by the regenerative chemical supplier by inverting the unit and filling the upper chamber 95 with dry chemical to an appropriate amount, securing the grid 94 in place on the conduit 100 after which the lower base section 92 and the diaphragm 91 are assembled to the housing section 90 as shown. The user may then connect such a container in position through use of a coupling or other similar device.

During use of the system, water is supplied to the container 90 in the same general manner as in FIGS. 1–4 to provide a solution therein. Water is supplied through conduit 100 and outlet port 100A to a point where diaphragm 91 is flexed downwardly toward the full line position illustrated in FIG. 5. As solution is withdrawn by pulling a vacuum in tube 105 diaphragm 91 flexes upwardly with the withdrawal of solution until the solution is substantially exhausted whereupon diaphragm 91 occupies the upper or dotted line position as illustrated in FIG. 5. In this position the diaphragm 91 seals against outlet port 100A to prevent further withdrawal of solution.

This arrangement is advantageous because the solution is withdrawn from lower chamber 96 which contains the relatively heavier and more saturated solution. The sealing of outlet port 100A by the diaphragm prevents withdrawal of all the liquid and insures the same volume displacement of solution for each cycle. When the system needs replacement of chemical the entire container is simply disconnected from the line and disposed of whereupon a new container is fitted in place.

Each of the embodiments of FIGS. 1–5 may be provided with quick disconnect and seal fittings in the solution line so that the lines may be detached and sealed when necessary to replace chemical.

We claim:

1. A regenerative chemical system including a substantially vertical closed container, a substantially horizontal perforated wall member dividing said container into an upper first chamber adapted to contain a solid regenerative chemical and a lower second chamber adapted to contain a liquid solution of said chemical and to allow liquid communication between said first and second chambers, said second chamber defining a bottom wall therein, said bottom wall including a vent in communication with the atmosphere; flexible diaphragm disposed in said second chamber between said bottom wall and said perforated wall member, said diaphragm and said perforated wall member cooperating to define a variable effective storage volume therebetween; liquid inlet-outlet in said container in communication with said effective storage volume and adapted to be connected to a source of inlet liquid and adapted for removal of said liquid solution whereby said flexible diaphragm is adapted to flex in response to addition or withdrawal of said liquid solution from said container to vary the variable effective storage volume of said container.

2. A system as in claim 1 wherein said container includes a first cylindrical section having a removable closure for an upper end thereof and a removable closure for the lower end thereof, said diaphragm being clamped between said cylindrical section and the closure for the lower end of said cylindrical section.

3. The system as recited in claim 1 wherein said diaphragm is adapted to seal off communication between said variable effective storage volume of said second chamber and said fluid inlet and prevent further withdrawal of solution upon removal of a predetermined volume of solution from said container.

* * * * *